US008452196B2

(12) United States Patent
Kazama et al.

(10) Patent No.: US 8,452,196 B2
(45) Date of Patent: May 28, 2013

(54) DEVICE FOR MEASURING LENGTH OF RECORDING MATERIAL, IMAGE FORMING APPARATUS AND COMPUTER READABLE MEDIUM

(75) Inventors: Toshiyuki Kazama, Ebina (JP); Koji Morofuji, Tokyo (JP); Takeshi Kato, Ebina (JP); Kozo Tagawa, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 415 days.

(21) Appl. No.: 12/722,258

(22) Filed: Mar. 11, 2010

(65) Prior Publication Data

US 2011/0064425 A1 Mar. 17, 2011

(30) Foreign Application Priority Data

Sep. 15, 2009 (JP) ..... 2009-212940

(51) Int. Cl.
*G03G 15/00* (2006.01)

(52) U.S. Cl.
USPC ..... 399/16; 399/389; 399/394; 399/395; 271/226; 271/227

(58) Field of Classification Search
USPC ..... 399/401, 394, 395, 16, 389, 372, 399/387; 271/226, 227
See application file for complete search history.

(56) References Cited

U.S. PATENT DOCUMENTS

| | | | | |
|---|---|---|---|---|
| 4,944,505 | A * | 7/1990 | Sherman, III | 271/265.03 |
| 5,172,907 | A * | 12/1992 | Kalisiak | 271/227 |
| 5,174,562 | A * | 12/1992 | Mizunaga et al. | 271/261 |
| 6,779,791 | B2 * | 8/2004 | Kawamura et al. | 271/228 |
| 7,561,843 | B2 * | 7/2009 | deJong et al. | 399/364 |
| 2007/0023995 | A1 * | 2/2007 | Onodera | 271/226 |

FOREIGN PATENT DOCUMENTS

JP 2005-112543 A 4/2005

OTHER PUBLICATIONS

U.S. Appl. No. 12/547,107, filed Aug. 25, 2009, Minoru Ohshima, et al.

* cited by examiner

*Primary Examiner* — Matthew G Marini
(74) *Attorney, Agent, or Firm* — Sughrue Mion, PLLC

(57) ABSTRACT

A device for measuring a length of a recoding material, includes: a rotating body that rotates in contact with a recording material which is transported; a length measuring unit that measures a length of the recording material based on a rotation of the rotating unit; a detecting unit that detects at least one of a rotation and an oblique advance of the recording material; and a correcting unit that corrects a value measured by the length measuring unit based on an output of the detecting unit.

8 Claims, 10 Drawing Sheets

DEVICE FOR MEASURING LENGTH OF RECORDING MATERIAL, IMAGE FORMING APPARATUS AND COMPUTER READABLE MEDIUM

CROSS-REFERENCE TO RELATED APPLICATION

This application is based on and claims priority under 35 USC 119 from Japanese Patent Application No. 2009-212940 filed on Sep. 15, 2009.

BACKGROUND

Technical Field

The present invention relates to a device for measuring a length of a recording material, an image forming apparatus and a computer readable medium.

SUMMARY

According to an aspect of the invention, a device for measuring a length of a recoding material, includes: a rotating body that rotates in contact with a recording material which is transported; a length measuring unit that measures a length of the recording material based on a rotation of the rotating unit; a detecting unit that detects at least one of a rotation and an oblique advance of the recording material; and a correcting unit that corrects a value measured by the length measuring unit based on an output of the detecting unit.

BRIEF DESCRIPTION OF THE DRAWINGS

Exemplary embodiments of the invention will be described in detail based on the following figures, wherein.

DETAILED DESCRIPTION

1. First Exemplary Embodiment
(Image Forming Apparatus)

Figure 1:
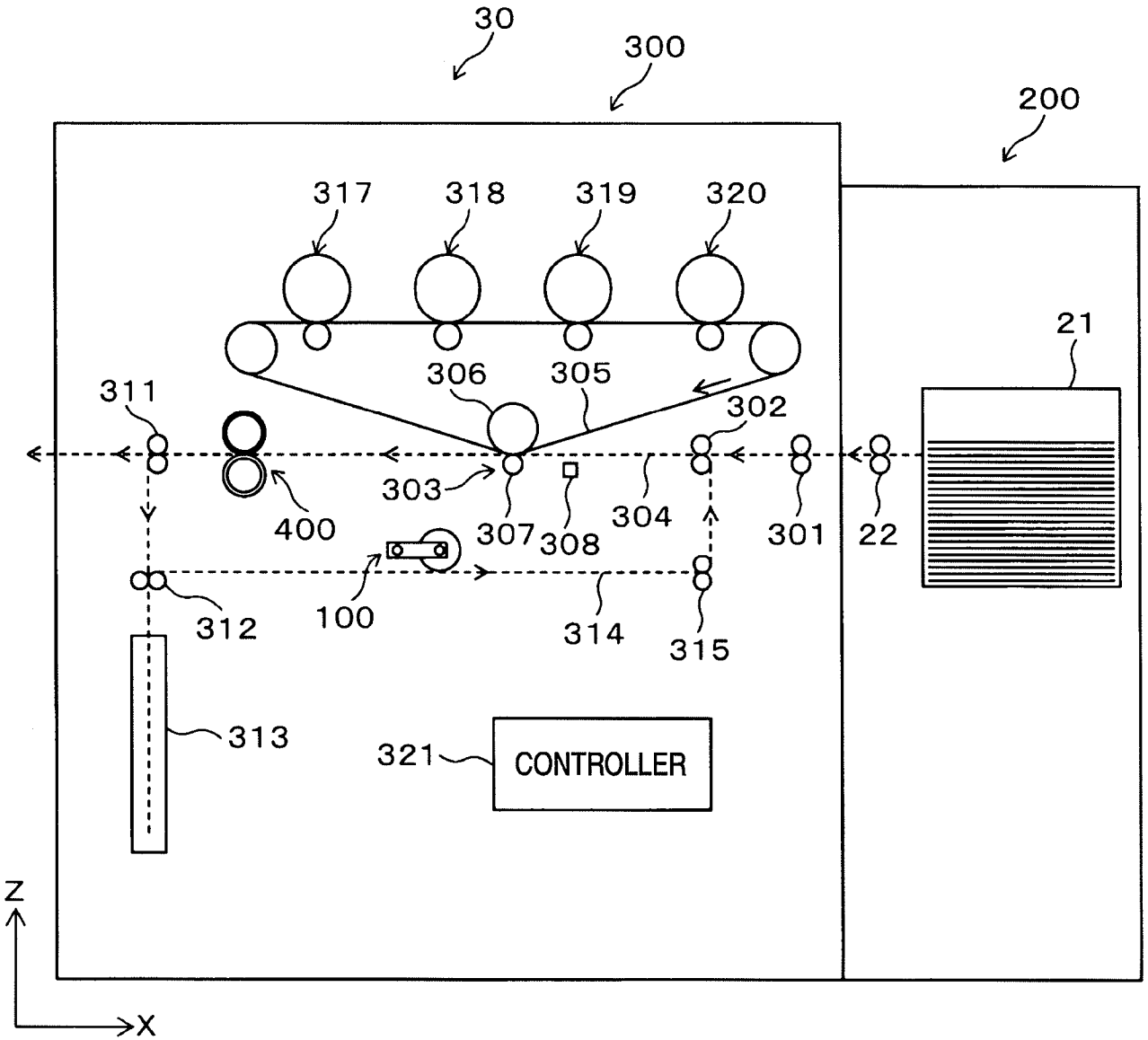
FIG. 1 is a conceptual view showing an image forming apparatus according to an exemplary embodiment.

FIG. 1 is a conceptual view showing an image forming apparatus according to an exemplary embodiment. FIG. 1 shows an image forming apparatus 30. The image forming apparatus 30 includes a paper supplying unit 200 for supplying a paper according to an example of a recording material, an image forming unit 300 according to an example of image forming unit, and a fixing device 400.

The paper supplying unit 200 includes a paper accommodating device 21 which accommodates plural of papers therein, a sending mechanism (not shown) for sending the paper from the paper accommodating device 21 in a leftward direction in the drawing, and a transporting roll 22 for transporting the paper sent from the sending mechanism in the leftward direction in the drawing. The paper is a sheet-like recording material and the case of a paper will be described in the example. The recording material is not restricted to the paper but may be a sheet-like resin material (for example, an OHP paper) or a paper material subjected to resin coating.

The image forming unit 300 includes a transporting roll 301 for taking the paper sent from the paper supplying unit 200 into the image forming unit 300. A transporting roll 302 is disposed on a downstream side of the transporting roll 301. The transporting roll 302 serves to send the paper fed from the transporting roll 301 or the paper fed from a transporting roll 315 which will be described below toward a secondary transferring portion 303. The secondary transferring portion 303 includes a transferring roll 306 and an opposite roll 307 and interposes a transferring belt 305 and the paper therebetween, thereby transferring, onto the paper, a toner image on the transferring belt 305.

The reference numeral 308 denotes a paper detecting sensor for optically detecting the paper transported toward the secondary transferring portion 303. The paper detecting sensor 308 optically detects the transported paper. The paper detecting sensor 308 detects a position on a paper transporting path 304 and outputs a result to a controller 321 which will be described below.

The fixing device 400 for fixing the toner image on the paper onto the paper by heating and pressurization is disposed on a downstream side of the secondary transferring portion 303. A transporting roll 311 is disposed on a downstream side of the fixing device 400. The transporting roll 311 sends the paper fed from the fixing device 400 to an outside of the apparatus or toward a transporting roll 312.

In the case in which an image is formed on both surfaces of the paper, the transporting roll 311 sends the paper to the transporting roll 312 in a stage in which an image is ended to be formed on a first surface (in a stage in which the fixation processing is ended). The paper is sent to an inverting device 313. The inverting device 313 sends (switches) the fed paper back to the transporting roll 312, and the transporting roll 312 sends the paper discharged from the inverting device 313 to a transporting path 314. In this case, the paper transported through the transporting path 314 has right and back sides inverted as compared with the case in which the paper is first transported through the transporting path 304.

A paper information detecting portion 100 which will be described below is disposed on the transporting path 314. A length of the paper in the transporting direction is calculated based on various information detected by the paper information detecting portion 100. There will be described information detected by the paper information detecting portion 100 and contents of a calculation related thereto.

The paper passing through the paper information detecting portion 100 is sent from the transporting roll 315 to the transporting roll 302, and furthermore, to the transporting path 304. The paper transported through the transporting path 304 again is fed to the secondary transferring portion 303 so that a secondary transfer of an image onto a second surface is carried out.

Primary and secondary transfer processings for an image formed on the second surface are controlled based on the information about the length of the paper which is calculated on the basis of the information given from the paper information detecting portion 100. The reason is that a forming position of the image to be formed on the second surface is to be prevented from being shifted due to a change in a dimension of the paper which is generated by an influence of the image formed on the first surface.

The image forming unit 300 includes primary transferring units 317, 318, 319 and 320. Each of the primary transferring units includes a photosensitive drum, a cleaning device, a charging device, an exposing device, a developing device and a transferring roll. The primary transferring units 317, 318, 319 and 320 transfer toner images of Y (yellow), M (magenta), C (cyan) and K (black) in a superposition on the transferring belt 305 which is being rotated. Consequently, the toner images of Y, M, C and K are superposed so that a color toner image is formed on the transferring belt 305.

The operation of each of the components described above is controlled through the controller 321. The controller 321 carries out various calculations for measuring the length of the paper, and furthermore, a calculation for obtaining a deformation of the paper. Moreover, the controller 321 controls an image formation processing which takes a change in a dimension of the paper or a deformation thereof into consideration in an image formation processing for the second surface in an execution of an image formation on both surfaces of the paper.

(Paper Information Detecting Portion)

Figure 2A:
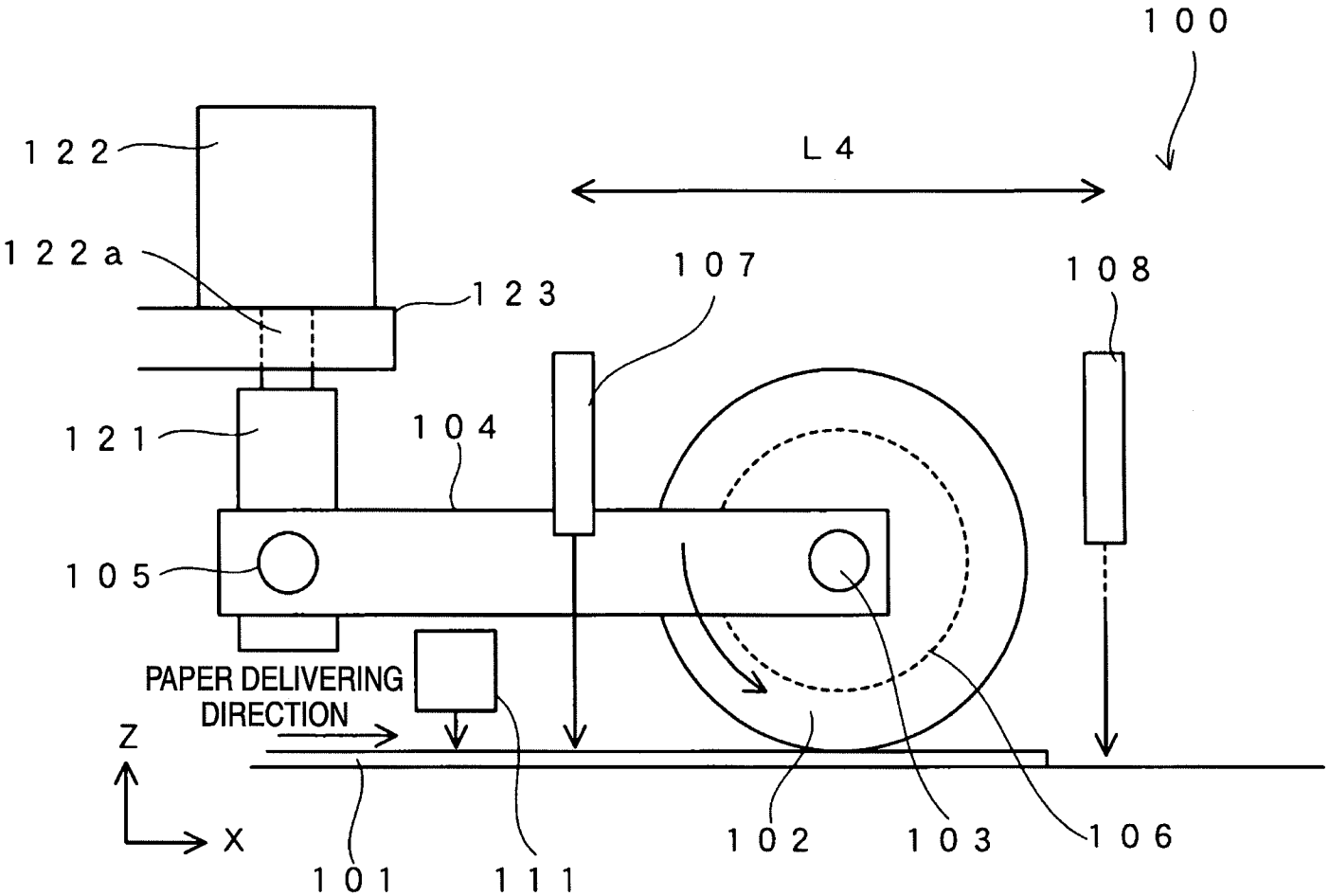
FIG. 2A is a conceptual view showing a portion for measuring a length of a paper in a state seen from a side surface
Figure 2B:
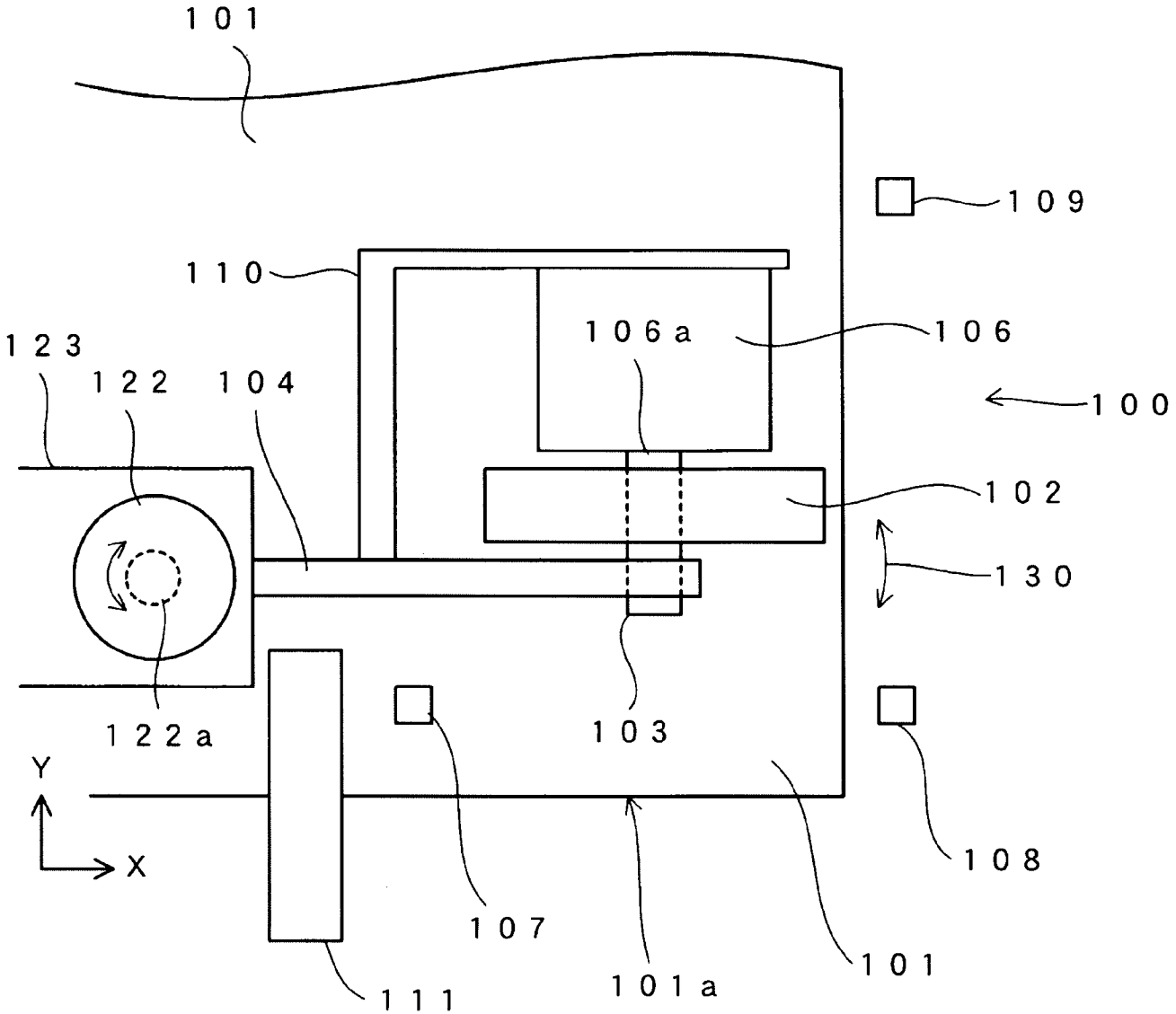
FIG. 2B is a conceptual view showing a portion for measuring a length of a paper in a state seen from an upper surface.

FIGS. 2A and 2B are a conceptual view showing the paper information detecting portion 100 in FIG. 1. FIG. 2A shows a state seen from a side surface and FIG. 2B shows a state seen from an upper surface. In other words, a state seen in a Z-axis direction of FIG. 2A is shown in FIG. 2B and a state seen in a Y-axis negative direction of FIG. 2B is shown in FIG. 2A.

FIGS. 2A and 2B show the paper information detecting portion 100. In the paper information detecting portion 100, a paper 101 is transported in a rightward direction (an X-axis positive direction) from left in the drawing. The reference numeral 102 denotes a length measuring roller to be a rotor for measuring a length. The length measuring roller 102 has a rotating shaft 103, and is rotated in contact with the transported paper 101.

A rotating shaft 106*a* of a rotary encoder 106 for outputting information about a rotating angle through a pulse signal is coupled to the rotating shaft 103. A body of the rotary encoder 106 is fixed to a support arm 104 through a support member 110.

The rotating shaft 103 is supported on the support arm 104 in a rotatable state, and the support arm 104 is attached, through a vertical rocking shaft 105, to a transverse rocking shaft 121 in a state in which a portion of the rotating shaft 103 may be vertically rocked. The transverse rocking shaft 121 serves to carry out a rocking motion to be a transverse rotation as seen on a viewpoint in the Z-axis direction (FIG. 2B) in the drawing. The transverse rocking shaft 121 is coupled to a rotating shaft 122*a* of a rotary encoder 122. The rotary encoder 122 is attached to a part 123 of a housing in the image forming unit 300 (see FIG. 1).

According to the structure, the length measuring roller 102 may be rocked in a vertical direction in the drawing around the rocking shaft 105. In this case, the rotary encoder 106 is also rocked vertically following the vertical motion of the length measuring roller 102. Consequently, a contact of the length measuring roller 102 following an upper surface of the paper 101 is ensured.

In a process in which the paper 101 in FIG. 2A or 2B is transported in a direction from left to right in the drawing, the paper 101 comes in contact with the length measuring roller 102. In this case, the length measuring roller 102 coming in contact with the paper 101 is rotated in a counterclockwise direction in the drawing with the movement of the paper 101. The rotation is detected by the rotary encoder 106 and a pulse electric signal corresponding to a rotating angle is output from the rotary encoder 106.

In the case in which the paper 101 is advanced obliquely to an X-axis direction, moreover, the support arm 104 is rocked in a transverse direction as seen on a viewpoint of FIG. 2B (the reference numeral 130) around the transverse rocking shaft 121 following a direction of the oblique advance. The rocking motion in the transverse direction indicated as the reference numeral 130 is detected by the rotary encoder 122 through the rotating shaft 122*a*.

In other words, even if a transporting direction of the paper 101 is oblique to an X axis, the rocking motion 130 is generated in such a manner that a tangential direction of a circumferential surface of the length measuring roller 102 follows the transporting direction of the paper 101. For this reason, a relative rolling direction of the length measuring roller 102 may be adapted to the moving direction of the paper 101 so that a slip between both of them is decreased and the length measuring roller 102 is rotated accurately following the movement of the paper 101.

FIGS. 2A and 2B shows an edge sensor 107, an edge sensor 108 and an edge sensor 109. The edge sensor 107 is disposed on an upstream side of the length measuring roller 102 in the transporting direction of the paper 101, and the edge sensor 108 is disposed on a downstream side of the length measuring roller 102. In FIG. 2B, the edge sensor 109 is hidden behind the edge sensor 108.

The edge sensors 107, 108 and 109 include a light emitting diode (not shown) and a photodiode (not shown). A reflected light of a light irradiated from the light emitting diode is detected by the photodiode so that an edge part of the paper 101 is detected.

The edge sensors 107, 108 and 109 detect an edge (a front end) on a front side of the transported paper 101 and an edge (a rear end) on a rear side thereof. In other words, when the front end of the paper 101 passes through a portion provided under the edge sensor 107, an output of the edge sensor 107 is changed from a non-detecting state (an output L level) to a detecting state (an output H level). When the rear end of the paper 101 passes through the portion provided under the edge sensor 107, the output of the edge sensor 107 is changed from the detecting state (the output H level) to the non-detecting state (the output L level). Consequently, the front and rear ends of the paper 101 are optically detected through the edge sensor 107. This is the same as in case of the edge sensors 108 and 109. A front part indicates a forward direction regarded to be the transporting direction and a rear part indicates a reverse direction thereto.

The edge sensors 107 and 108 are utilized when measuring a length of the paper in cooperation with the length measuring roller 102. The edge sensors 108 and 109 detect different parts of the front end of the paper 101 and acquire information about whether an extending direction of the front end of the paper 101 is inclined to the X-axis direction or not, and furthermore, a degree of the inclination. In the example, the edge sensors 108 and 109 are disposed on a line (a Y axis) which is orthogonal to the transporting direction of the paper 101. By checking timings for the outputs of both of the edge sensors, it is possible to know a state of the inclination of the front end of the paper 101 in the transporting process with respect to the Y axis.

By the same principle, moreover, the edge sensors 108 and 109 detect different parts of the rear end of the paper 101 and acquire information about whether an extending direction of the rear end of the paper 101 is inclined to the Y-axis direction or not, and furthermore, a degree of the inclination. Based on the outputs of the edge sensors 108 and 109, it is possible to obtain information about a rotation of the paper (a rotation seen on the viewpoint of FIG. 2B) and a deformation of the front end and/or the rear end of the paper.

The paper information detecting portion 100 includes an image sensor 111. The image sensor 111 optically detects a position of an edge (a side end) 101*a* on a right side seen from above the paper 101 transported in the X-axis direction in the drawing (a position on the Y axis). By the image sensor 111, it is possible to obtain information about whether the paper 101 is advanced obliquely or not.

(Referring to Rotation/Oblique Advance of Paper)

Figure 3A:
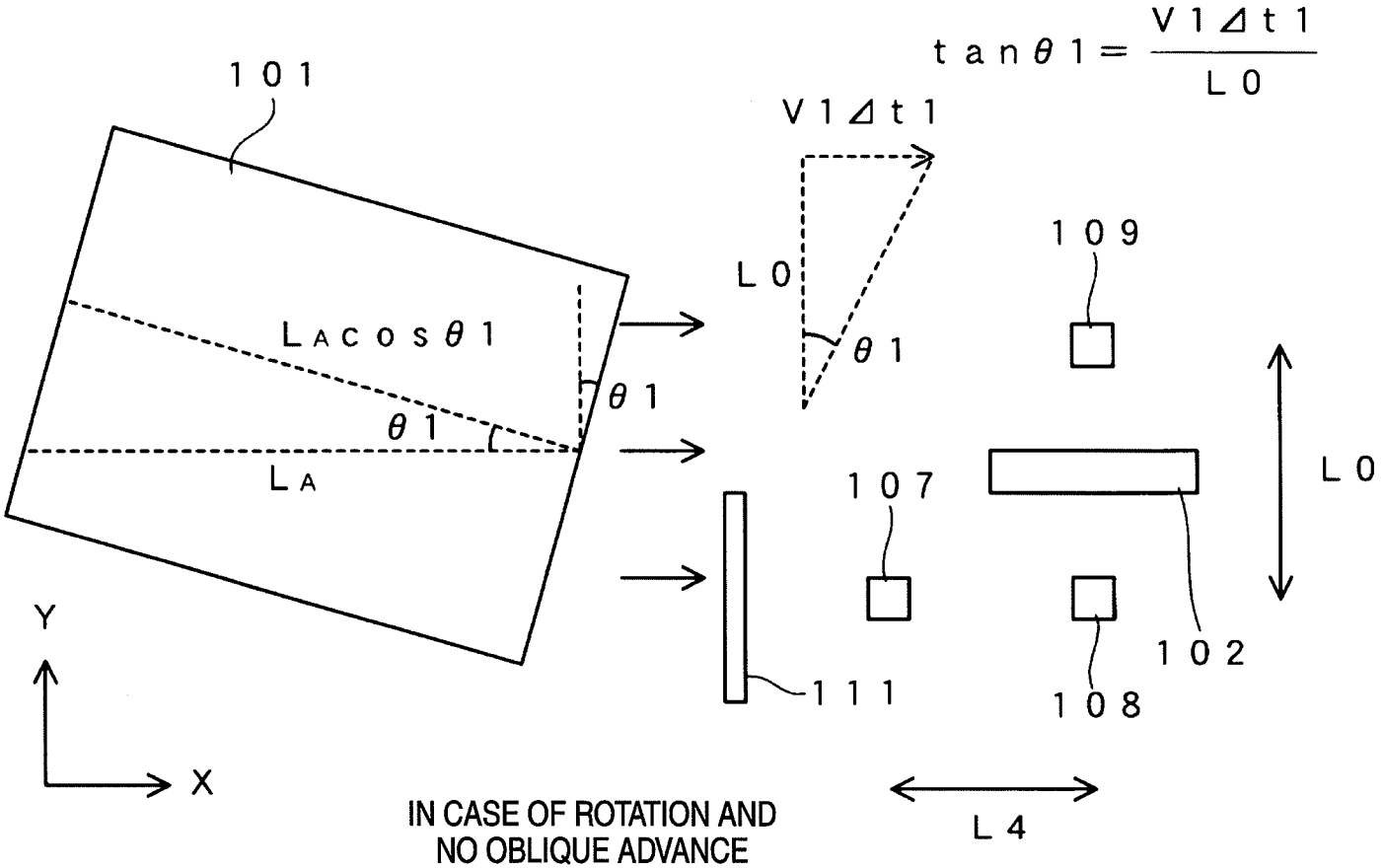
FIG. 3A is a conceptual view for explaining a state of a rotation of the paper.
Figure 3B:
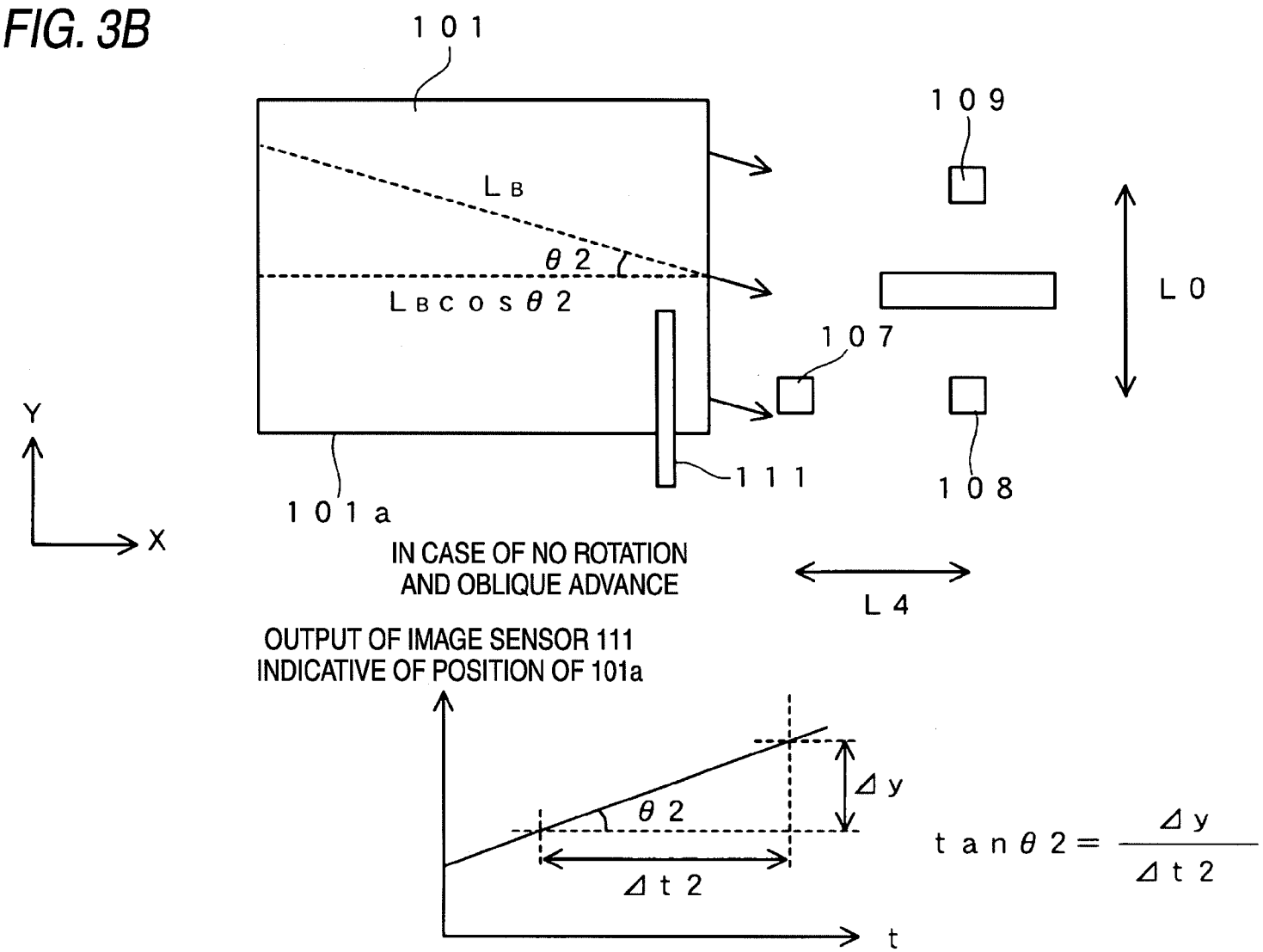
FIG. 3B is a conceptual view for explaining a state of an oblique advance of the paper.

FIGS. 3A and 3B are a conceptual view showing, with an exaggeration, a state of a paper during a transport. FIGS. 3A and 3B conceptually show a state in which the paper 101 is transported in the X-axis direction (a rightward direction in the drawing). FIG. 3A shows a state in which the paper 101 is transported with a rotation at an angle θ1 (a condition of a skew) in the X-axis direction (a normal condition) and without an oblique advance in the normal condition (that is, the paper 101 is transported in the X-axis direction). FIG. 3B shows a state in which the paper 101 is transported without a rotation in the normal condition and with an oblique advance at an angle θ2 with respect to the X-axis direction.

(Principle of Correction)

In case of FIG. 3A, LA is obtained from a rotation of the length measuring roller 102. Since the paper 101 is rotated at θ1, however, an actual paper length is LA cos θ1. In case of FIG. 3B, LB is obtained from the rotation of the length measuring roller 102. Since the paper 101 is obliquely advanced at an angle θ2, however, the actual paper length is LB cos θ2.

In case of FIG. 3A, accordingly, the actual paper length may be calculated from the rotation of the length measuring roller 102 if θ1 is known. In this case, θ1 is obtained in $\tan \theta 1 = V1 \Delta t1 / L0$ by using a difference Δt1 between times that the edge sensors 108 and 109 detect the front end of the paper, a paper transporting speed V1 and an interval L0 between the edge sensors 108 and 109.

In case of FIG. 3B, moreover, the actual paper length may be calculated from the rotation of the length measuring roller 102 if θ2 is known. θ2 may be obtained from an output of the image sensor 111. The image sensor 111 detects a position on the Y axis of the side end 101*a* of the paper 101. θ2 is obtained in $\tan \theta 2 = (\Delta y / \Delta t2)$, wherein a distance of the side end 101*a* displaced on the Y axis at a certain time interval Δt2 is represented by Δy.

(Structure of Control System)

Figure 4:
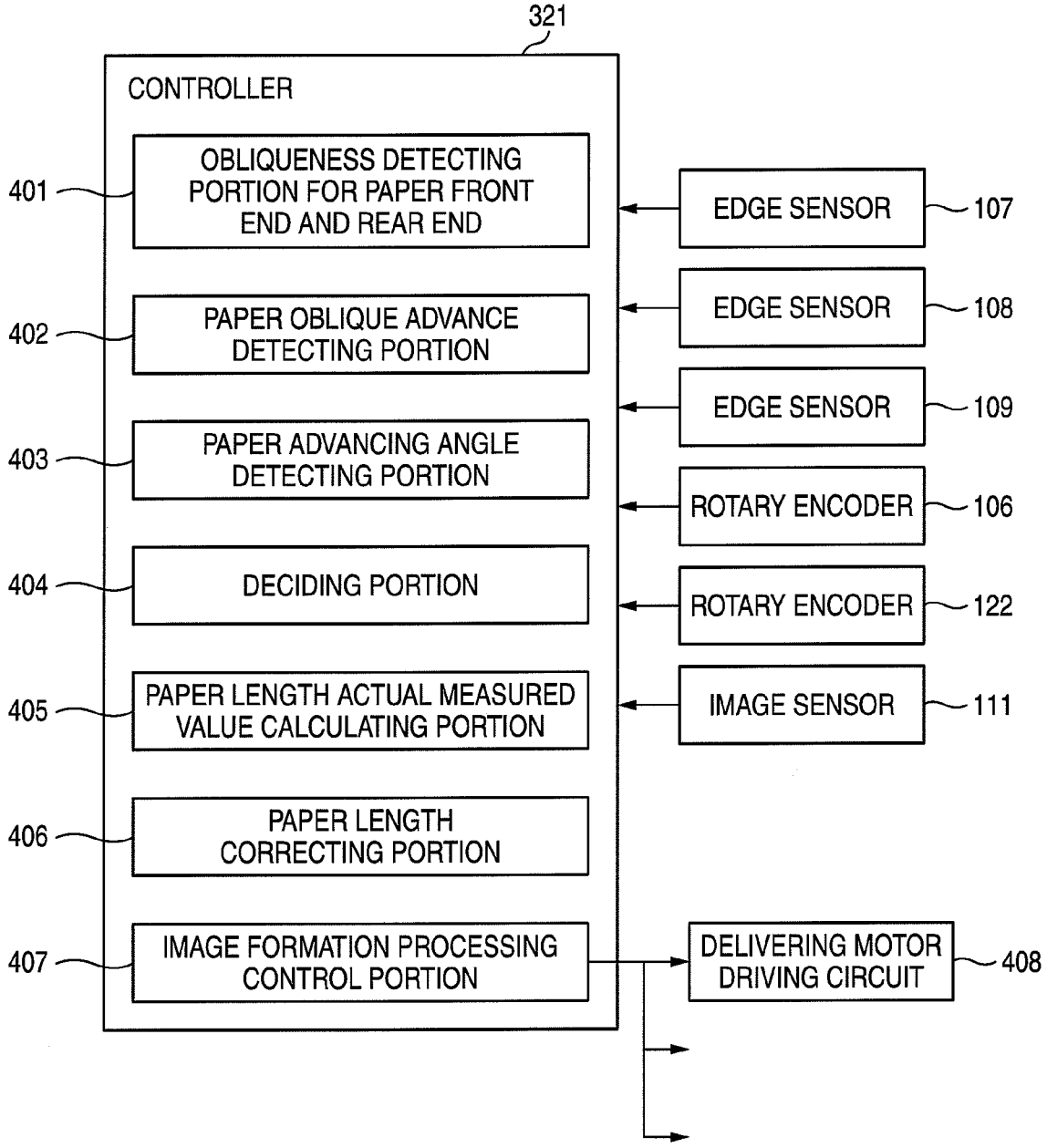
FIG. 4 is a block diagram showing a control system.

FIG. 4 is a block diagram showing the controller 321 and a peripheral structure thereof. FIG. 4 shows the controller 321 which is also illustrated in FIG. 1. The controller 321 has a function of a microcomputer and includes a CPU, a memory, a reference clock and an interface. The controller 321 chiefly controls a whole operation of the image forming apparatus 30 and executes a processing of a flowchart which will be described below.

The controller 321 includes, as functional portions constituted in software, a obliqueness detecting portion 401 for paper front end and rear end, a paper oblique advance detecting portion 402, a paper advancing angle detecting portion 403, a deciding portion 404, a paper length actual measured value calculating portion 405, a paper length correcting portion 406, and an image formation processing control portion 407.

The obliqueness detecting portion 401 detects whether the front and rear ends of the paper 101 are oblique to a normal extending direction (a Y-axis direction) or not based on the outputs of the edge sensors 108 and 109, and furthermore, an angle in the case in which they are oblique. In the example, the edge sensors 108 and 109 are disposed in positions placed apart from each other in the direction which is orthogonal to the transporting direction of the paper 101 (the Y-axis direction). By checking a difference between times for the outputs of the edge sensors 108 and 109, therefore, it is possible to know oblique states of the front and rear ends of the paper 101 (an angle formed with respect to the Y axis). By checking order of a change in the outputs of the two edge sensors, moreover, it is possible to know the extending directions of the front and rear ends of the paper 101.

The paper oblique advance detecting portion 402 detects a state in which the transported paper 101 is advanced obliquely based on the output of the image sensor 111. The image sensor 111 detects the inclination to the X-axis direction of the side end 101*a* of the paper 101. Therefore, the image sensor 111 decides "an oblique advance" in the case in which the paper 101 is maintained in a rotating state even if the paper 101 is not advanced obliquely. In this case, it is possible to decide presence of an actual oblique advance by utilizing a function of the paper advancing angle detecting portion 403 which will be described below. The processing will be described below.

The paper advancing angle detecting portion 403 detects a rocking angle of the length measuring roller 102 (an angle of a transverse oscillation) based on an output of the rotary encoder 122. The length measuring roller 102 may carry out the rocking motion indicated as the reference numeral 130. When the paper 101 is obliquely advanced so that a route thereof is inclined, therefore, the rocking motion is carried out in an X-Y plane in accordance with the inclination. An angle of the rocking motion is detected as an angle in the advancing direction of the paper 101 through the paper advancing angle detecting portion 403.

The deciding portion 404 makes various decisions shown in the flowchart which will be described below. The paper length actual measured value calculating portion 405 measures the length of the paper 101 based on the outputs of the edge sensors 107 and 108 and the output of the rotary encoder 106. The length of the paper measured by the paper length actual measured value calculating portion 405 is a dimension which is equivalent to LA or LB in FIGS. 3A and 3B.

Figure 5:
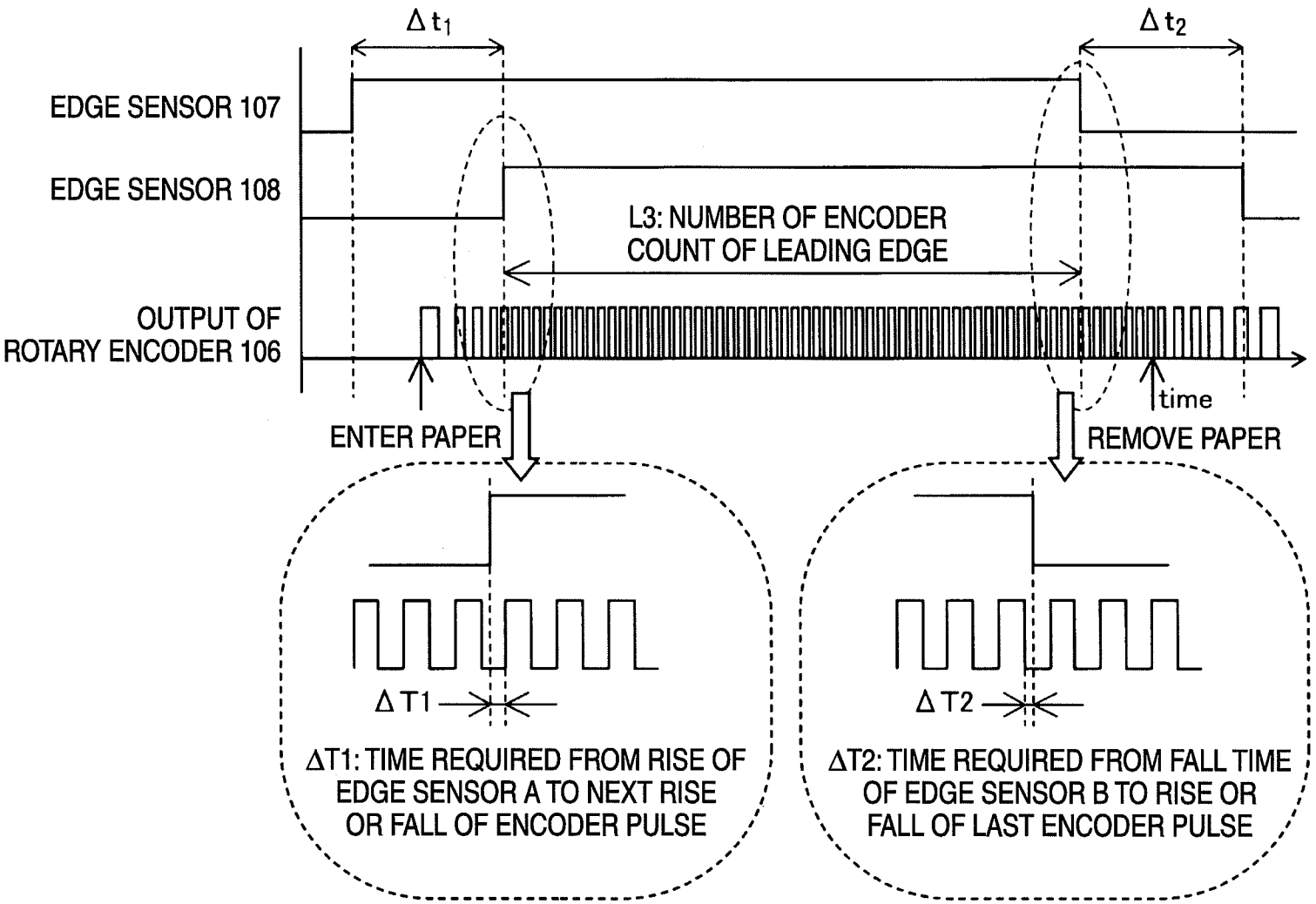
FIG. 5 is a principle diagram showing a principle of a measurement of a length of a paper.

Description will be given to a processing to be carried out by the paper length actual measured value calculating portion 405. FIG. 5 is a principle diagram showing a measuring principle for the length of the paper. In FIG. 5, an axis of abscissa indicates a time base. FIG. 5 shows an event generated in a stage in which the paper 101 reaches the paper information detecting portion 100 in FIGS. 2A and 2B.

When the paper 101 reaches the paper information detecting portion 100, the front end of the paper 101 is first detected by the edge sensor 107 so that the output of the edge sensor 107 is changed from L (a low level) to H (a high level). Then, the paper 101 comes in contact with the length measuring roller 102 (the paper 101 enters) so that the length measuring roller 102 starts a rotation and an output pulse of the rotary encoder 106 is started to be output. Subsequently, the front end of the paper 101 is detected by the edge sensor 108 so that the output of the edge sensor 108 is changed from L to H.

Precision in a measurement through the output pulse of the rotary encoder 106 is limited by a pulse interval. By utilizing a timing in which the front end of the paper 101 passes through a portion provided under the edge sensor 108, therefore, a length Lin of the front end of the paper 101 buried in the pulse interval is calculated.

In this case, a period of "XOR" of the outputs of the edge sensors 107 and 108 (either of them is an H output) is measured to obtain $\Delta t_1$ in FIG. 5. $\Delta t_1$ and L4 (a distance between the edge sensors) in FIGS. 2A and 2B are used to calculate a transporting speed V1 in the period $\Delta t_1$ and the transporting speed V1 and $\Delta$T1 are used to calculate Lin. The length Lin of the front end of the paper corresponds to be smaller than the output pulse interval of the rotary encoder 106. In this respect, a length Lout of the rear end of the paper which will be described below is the same.

Subsequently, L3 is calculated from the output pulse of the rotary encoder 106. Then, a timing in which the rear end of the paper 101 passes through the edge sensor 107 is utilized to calculate the length Lout of the rear end of the paper buried in the pulse interval.

In this case, the period of "XOR" of the outputs of the edge sensors 107 and 108 (either of them is the H output) is measured to obtain $\Delta t_2$ in FIG. 5. $\Delta t_2$ and L2 (a distance between the edge sensors) in FIGS. 2A and 2B are used to calculate a transporting speed V2 in the period $\Delta t_2$ and the transporting speed V2 and $\Delta$T2 are used to calculate Lout.

(Lin+Lout+L1) indicates the length of the paper which is measured for a period in which both of the edge sensors 107 and 108 are H, that is, the paper is present under both of the sensors. Therefore, (Lin+Lout+L3+L4) obtained by adding L4 (a distance between the edge sensors) to be a transporting distance during a passage under only one of the edge sensors is calculated as a length L in the transporting direction of the paper 101.

The paper length correcting portion 406 carries out a correction of a measuring error caused by the rotation of the paper, a correction of a measuring error caused by the oblique advance of the paper and a correction of a shift from a rectangular shape which is caused by an error in a cutting operation for a shape of the paper with respect to an actual measured value of the length of the paper which is obtained by the paper length actual measured value calculating portion 405. The details of a processing to be carried out in the paper correcting portion 406 will be described below.

The image formation processing control portion 407 controls an image formation processing to be carried out in the image forming unit 300 (see FIG. 1). FIG. 4 shows, as an example, a structure in which the image formation processing control portion 407 carries out an operation control of a transporting motor driving circuit 408 which is not shown in FIG. 1. The transporting motor driving circuit 408 serves to drive the transporting roll 302 in FIG. 1, for example. The image formation processing control portion 407 also carries out an operation control of the primary transferring units 317, 318, 319 and 320 and that of the transferring belt 305, which is not shown in FIG. 4.

Moreover, the image formation processing control portion 407 has a function for adjusting an image forming position in a second surface based on data on the length of the paper which are acquired after forming an image on a first surface when forming the image on both surfaces of the paper. By the function, the image is formed on the second surface in consideration of an influence of a shrinkage of the paper which is caused by the formation of the image on the first surface. Thus, it is possible to suppress a shift of the image forming positions on both surfaces of the paper.

(Example of Operation of Image Forming Apparatus)

Description will be given to an example of an operation in the case in which an image is formed on both surfaces of a paper in the image forming apparatus 30 shown in FIG. 1. First of all, the paper is sent from the paper accommodating device 21 through the transporting roll 22. The paper is supplied from the transporting path 304 to the secondary transferring portion 303. In the timing, a toner image is formed on the transferring belt 305 by means of the primary transferring units 317 to 320. Then, the toner image formed on the transferring belt 305 is secondarily transferred, in the secondary transferring portion 303, onto the paper transported through the transporting path 304 in a leftward direction in the drawing. The toner image thus transferred secondarily is fixed onto the paper by the fixing device 400. Thus, an image is formed on a first surface of the paper.

The paper on which the image is completely formed on one of the surfaces is sent from the transporting roll 311 toward the inverting device 313. The paper entering the inverting device 313 is switched back therein and is sent from the transporting roll 312 to the transporting path 314 in a state in which a second surface to be a back face of the first surface is set to be an upper surface. The paper sent to the transporting path 314 passes through the paper information detecting portion 100. At this time, a length of the paper is measured in the paper information detecting portion 100. A method of measuring the length of the paper and a method of correcting the same in this case will be described below.

The paper having the length measured in the paper information detecting portion 100 is sent to the transporting path 304 via the transporting rolls 315 and 302 again. In the timing, a toner image to be formed on a second surface of the paper is formed on the transferring belt 305 by means of the primary transferring units 317 to 320. At this time, a reduced scale of the toner image to be formed on (to be primarily transferred onto) the transferring belt 305 is adjusted based on data on the length of the paper which are obtained by a method which will be described below. The control is carried out in the image formation processing control portion 407 of FIG. 4.

In the secondary transferring portion 303, the toner image is secondarily transferred onto the second surface of the paper having the length measured by the paper information detecting portion 100. At this time, the paper is detected by the paper detecting sensor 308 and a control of a secondary transfer timing in the secondary transferring portion 303 is carried out based on a result of the detection and the data on the length of the paper which are obtained by the method which will be described below. The control is carried out in the image formation processing control portion 407 of FIG. 4.

Then, the paper is sent to the secondary transferring portion 400 and the image formed on the second surface is fixed therein. The paper having the second surface onto which the image is fixed is discharged from the transporting roll 311 to an outside of the image forming unit 300.

(Example of Operation for Measuring Length of Paper: Detail)

Figure 6:
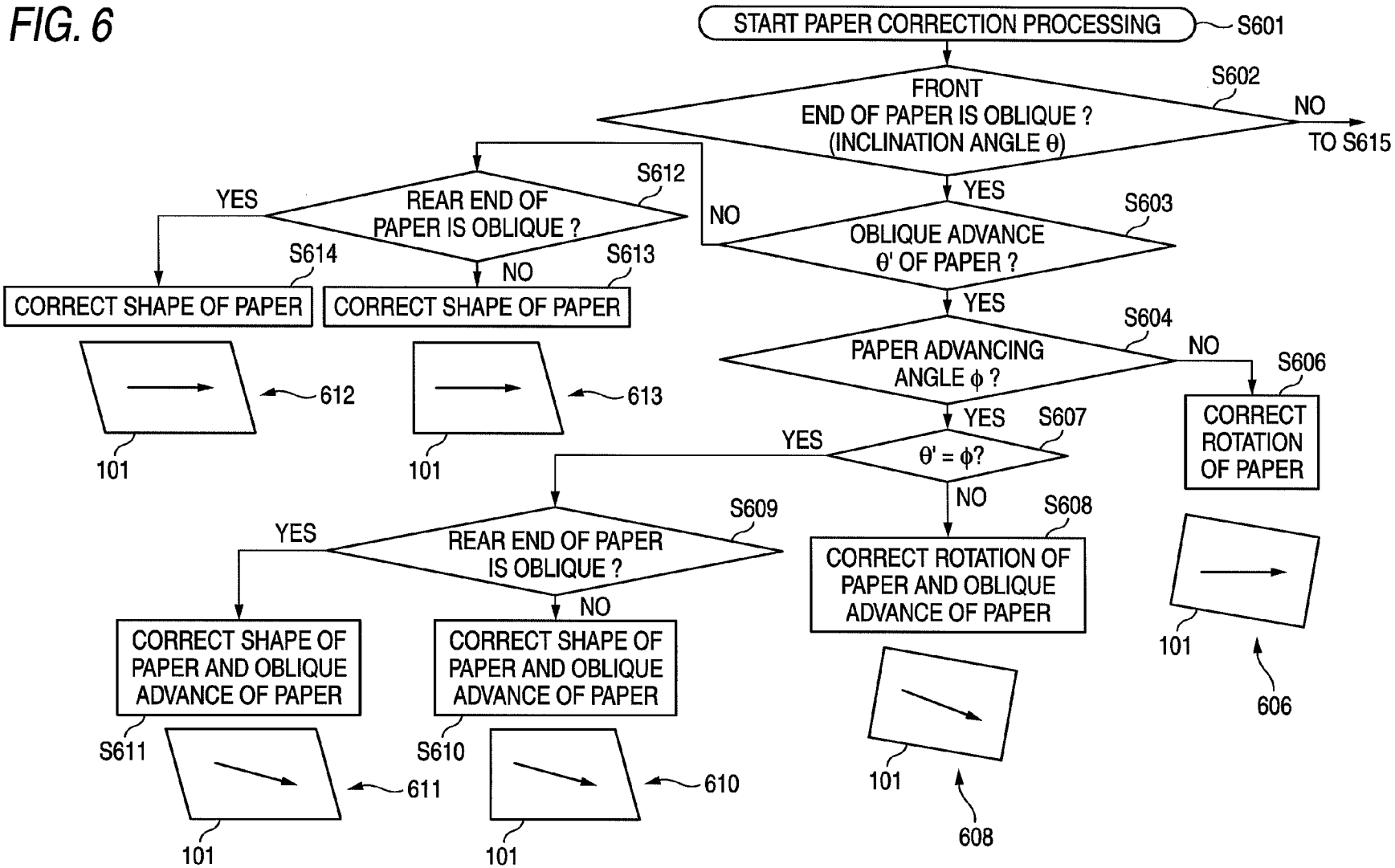
FIG. 6 is a flowchart showing a procedure for a processing according to the exemplary embodiment.
Figure 7:
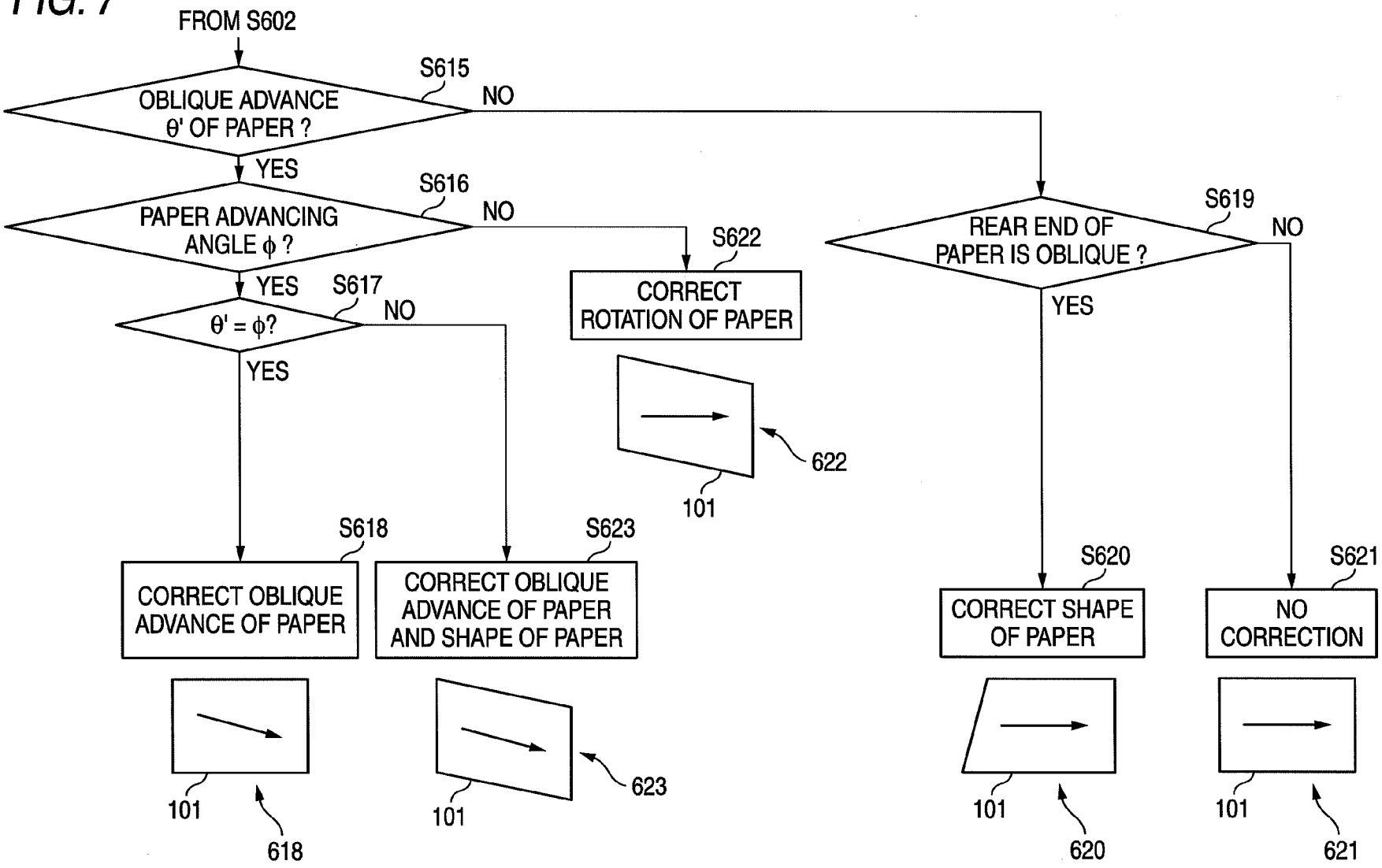
FIG. 7 is a flowchart showing a procedure for a processing according to the exemplary embodiment.

FIGS. 6 and 7 are flowcharts showing an example of a processing procedure to be carried out when measuring the length of the paper by utilizing the paper information detecting portion 100. A computer readable medium for executing the flowcharts shown in FIGS. 6 and 7 is stored in a memory provided in the controller 321, and is read into a proper memory area and is executed by a CPU in the controller 321. The computer readable medium for executing the flowcharts shown in FIGS. 6 and 7 may be stored in a proper storage medium and may be supplied therefrom.

When the paper 101 approaches the paper information detecting portion 100, the processing in FIG. 6 is started. When the processing is started (Step S601), whether a front end (an edge (a side) on a forward side in a transporting direction) of the paper 101 is oblique is decided by the deciding portion 404 (FIG. 4) (Step S602). In the processing, outputs of the edge sensors 108 and 109 are compared with each other in a paper front end and rear end obliqueness detecting portion 401 (see FIG. 4). In this case, it is decided that the front end of the paper is oblique if changes in the outputs of both of the edge sensors have a time difference, and it is decided that the front end of the paper is not oblique if the changes in the outputs of both of the edge sensors have no time difference. Moreover, an inclining direction is detected from order of the changes in the outputs of both of the edge sensors. The deciding portion 404 also carries out other decision processings shown in FIGS. 6 and 7.

Herein, "the front end of the paper is oblique" indicates a state in which an extending direction of the front end (an extending direction of the side) of the paper 101 is inclined to a direction which is orthogonal to the transporting direction of the paper 101.

The obliqueness detecting portion 401 calculates an inclination θ of the front end of the paper 101 (which is equivalent to θ1 in FIG. 3A) based on the principle shown in FIG. 3A. In this case, θ is calculated based on a difference in times for the outputs of both of the edge sensors and an interval between both of the edge sensors.

If the decision of the Step S602 is NO, the processing proceeds to Step S615 in FIG. 7 which will be described below. If the decision of the Step S602 is YES, the processing proceeds to Step S603. At the Step 603, it is decided whether the paper 101 is obliquely advanced or not based on an output of the image sensor 111. In the decision, an angle θ' (which is equivalent to θ2 in FIG. 3B) is calculated based on the principle shown in FIG. 3B in the obliqueness detecting portion 401 and it is decided whether θ'=0 is set or not.

If the oblique advance θ' of the paper is present (in case of θ'≠0) in the decision of the Step S603, the processing proceeds to Step S604. If not so, the processing proceeds to Step S612. At the Step S604, it is decided whether a paper advancing angle ϕ is present or not by referring to an output of the rotary encoder 122 in the paper advancing angle detecting portion 403. The paper advancing angle ϕ indicates a rotating angle of the transverse rocking shaft 121 which is detected by the rotary encoder 122 and an inclination, to the X axis, of a tangent touching a circumference (an outer circumference) of the length measuring roller 102 in the X-Y plane. If ϕ=0 is set, the processing proceeds to Step S606. If ϕ=0 is not set, the processing proceeds to Step S607.

At the Step S606, the paper 101 is regarded to be transported in the X-axis direction without an oblique advance in a state in which a rotation is carried out at an angle θ in a measurement performed by the length measuring roller 102 (a state of an image 606), and the length of the paper 101 (the paper length) is corrected. The correction is carried out by the paper length correcting portion 406 for the value measured based on the principle described with reference to FIG. 5. The correction of the length of the paper which will be described below is wholly carried out over the value measured based on the principle described with reference to FIG. 5 by the paper length correcting portion 406.

At the Step S607, it is decided whether 0'=ϕ is set or not. If θ'=ϕ is set, the processing proceeds to Step S609. If not so, the processing proceeds to Step S608.

At the Step S608, the paper 101 is regarded to be set in a state of an image 608 which is rotated and advanced obliquely in the measurement through the length measuring roller 102 and an error of the measured value of the length of the paper which is caused by the oblique advance of the paper (the angle θ'=ϕ) is corrected based on the principle shown in FIG. 3B. Moreover, a correction of the measured value of the length of the paper which is caused by the rotation of the paper at the angle θ is carried out based on the principle shown in FIG. 3A. The corrections are carried out by the paper length correcting portion 406. The paper length actual measured value L is corrected based on a correcting equation in which prepared θ' and θ are set to be variables (or a correcting data table).

At the Step S609, it is decided whether the rear end of the paper 101 is oblique or not based on the outputs of the edge sensors 108 and 109. The deciding procedure is the same as that in the case in which it is decided whether the front end of the paper at the Step S602 is oblique or not. In this case, moreover, there is also acquired information about a degree of the obliqueness. In the decision of the Step S609, the processing proceeds to Step S611 if the rear end of the paper 101 is oblique, and proceeds to Step S610 if not so.

At the Step S611, in the measurement to be performed by the length measuring roller 102, the paper 101 is regarded to be set into a state in which the front and rear ends are oblique and the paper 101 is advanced obliquely without a rotation in the measurement to be performed by the length measuring roller 102 as shown in an image 611, and a correction related to the shape of the paper and a correction related to the oblique advance are carried out. Although an example of a parallelogram is shown in the image 611, the paper 101 takes a trapezoidal shape (not shown) in the case in which the oblique condition of the rear end and that of the front end are reversed on left and right.

The correction related to the shape of the paper is carried out based on data obtained by previously checking a relationship between a degree of a deformation of the shape of the paper and a correction factor. This respect is also the same as in a correction of another shape of the paper.

Returning to the Step S603, if the oblique advance of the paper 101 is not present (in case of θ'=0), the processing proceeds to the Step S612 in which it is decided whether the rear end of the paper 101 is oblique or not. If the rear end of the paper 101 is oblique, the processing proceeds to Step S614. If not so, the processing proceeds to Step S613.

At the Step S613, the paper 101 is regarded to be set into a condition of an image 613 which has no rotation, no oblique advance and an oblique deformation of the front end, and there is carried out a correction of the length of the paper 101 related to the deformation of the paper 101. At the Step S614, the paper 101 is regarded to be set into a condition of an image 612 which has no rotation, no oblique advance and an oblique deformation of the front and rear ends and there is carried out the correction of the length of the paper 101 related to the deformation of the paper 101.

Returning to the Step S602, if the front end of the paper 101 is not oblique in the decision of the Step S602, the processing proceeds to the Step S5615 in FIG. 7. At the Step S615, it is decided whether the oblique advance θ' of the paper 101 is present or not in the same manner as in the Step S603. If the oblique advance θ' is present, the processing proceeds to Step S616. If not so, the processing proceeds to Step S619 which will be described below.

At the Step S616, it is decided whether the paper advancing angle ϕ is present or not in the same manner as in the Step S604. If the paper advancing angle of ϕ≠0 is set, the processing proceeds to Step S617. If not so, the processing proceeds to Step S622 which will be described below.

At the Step S617, it is decided whether θ'=ϕ is set or not. If θ'=ϕ is set, the processing proceeds to Step S618. If not so, the processing proceeds to the Step S623. At the Step S618, the paper 101 is regarded to have no rotation, an oblique advance and no deformation as shown in an image 618, and there is carried out only a correction of the length of the paper related to the oblique advance. At the Step S623, the paper 101 is regarded to have no rotation, an oblique advance and a deformation as shown in an image 623, and there are carried out a correction of the length of the paper related to the oblique advance and a correction of the length of the paper related to a shape shown in the drawing.

Returning to the Step S615, if the oblique advance of the paper 101 is not present, the processing proceeds to the Step S619 in which it is decided whether the rear end of the paper 101 is oblique or not. If the rear end of the paper 101 is oblique, the processing proceeds to Step S620. If not so, the processing proceeds to Step S621.

At the Step S620, the paper 101 is regarded to have no rotation, no oblique advance and an oblique deformation of the rear end as shown in an image 620, and there is carried out a correction of the length of the paper related to the deformation of the paper 101.

At the Step S621, the paper 101 is regarded to have no rotation, no oblique advance and no deformation as shown in an image 621, and the correction of the length of the paper 101 is not carried out.

As described above, in the formation of the image on both surfaces of the paper, the image is ended to be formed on the first surface and the length (the length of the paper) in the transporting direction of the paper (a transporting direction in respect of a design) is then acquired. In this case, there is detected an influence of a deformation from a specified shape (a rectangle in many cases) of the paper which is caused by the rotation or oblique advance of the paper, or a cutting error of the paper itself in the measurement of the paper, and there is carried out a correction for reducing the error made by the influence. Based on data on the length of the paper which is corrected, subsequently, a forming position of the image on the second surface or a reduced scale of the image is adjusted. Thus, there is executed an image formation processing for preventing a positional shift of the image from occurring over both surfaces of the paper.

(Superiority)

Referring to the processings shown in FIGS. 6 and 7, the correction for the length of the paper which is actually measured is carried out in consideration of the influence of the rotation of the paper, the oblique advance and the deformation from the specified shape of the paper in the measurement of the length of the paper in the processing for obtaining the length of the paper. Even if the paper is rotated, is oblique or is deformed from the specified shape in the measurement of the length of the paper, therefore, it is possible to prevent a measuring error of the length of the paper from being caused by the influence.

In the case in which a fine image such as a photographic image is formed by a perfecting print, a requirement for a shift in a paper transporting direction of images on right and back sides tends to be strict. Referring to a fine color image for which a comparatively large amount of toner is used or a formation of an image which is carried out at a high printing speed, moreover, a change in a dimension of a paper after a fixation tends to often occur. In this case, there is also increased a requirement for precision in the measurement of the length of the paper after a formation of an image on a first surface. According to the exemplary embodiment, the precision in the measurement of the length of the paper may be enhanced. In this respect, the exemplary embodiment has a superiority.

(Others)

Although FIG. 1 illustrates the structure in which the length of the paper is measured before the formation of the image on the second surface in the formation of the image on both surfaces of the paper, it is also possible to employ a structure in which the length of the paper is measured before the formation of the image on the first surface and is utilized for forming the image on the first surface. In a structure in which an image may be formed on only one of surfaces in place of a perfecting print, moreover, it is also possible to measure the length of the paper before the formation of the image and to reflect the formation of the image by the result.

Although the edge sensors 108 and 109 are disposed as the edge sensors for detecting the front and rear ends of the paper 101 in the exemplary embodiment, it is also possible to further dispose at least three edge sensors, thereby detecting the front and rear ends of the paper 101.

The oblique advance of the paper is not restricted to an oblique advance which is not intended. For example, there has been known a mechanism for pushing a paper against a side guide disposed in a side portion of a transporting path and correcting a position of the side portion of the paper during a transport over the transporting path. In the mechanism, the paper which is being transported is intentionally transported in an oblique direction and is forced to be advanced obliquely. In the case in which a length of the paper in this condition is measured, the invention may also be utilized.

2. Second Exemplary Embodiment

For example, in the case in which a paper 101 is transported with a rotation generated (a change in a rotating angle generated), a time variation in an output of an image sensor 111 indicates a nonlinear change. In some cases in which a degree of the nonlinear change is high, a reliability of a measured value is greatly reduced so that necessary precision for forming an image on a second surface of the paper cannot be obtained by the method of measuring the length of the paper and the method of correcting the same according to the first exemplary embodiment.

In these cases, it is possible to propose a structure in which a degree of a nonlinearity is decided based on a predetermined decision criterion and a mode using no paper length data is executed for forming an image on a second surface based on the decision.

Figure 8:
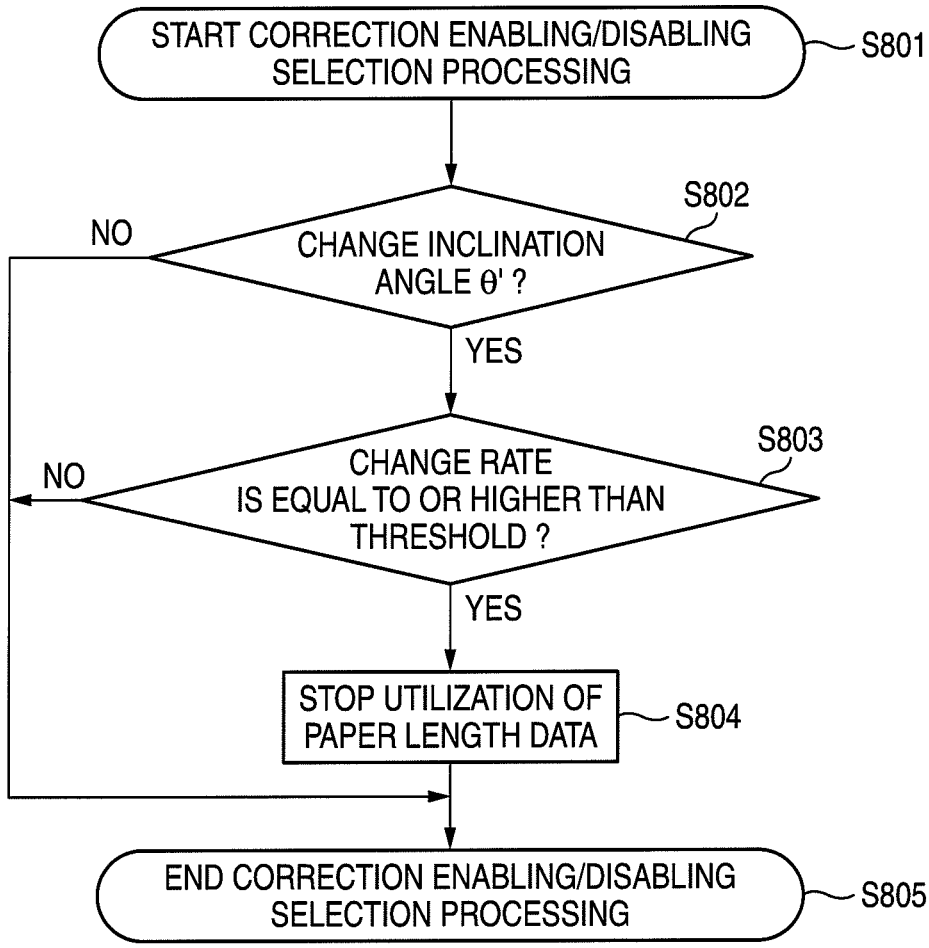
FIG. 8 is a flowchart showing a procedure for a processing according to the exemplary embodiment.

An example will be described below. FIG. 8 is a flowchart showing a processing procedure according to the exemplary embodiment. The processing shown in FIG. 8 is executed simultaneously with the processings of FIGS. 6 and 7 through the controller 321 in FIG. 4.

When the processing is first started (Step S801), a deciding portion 404 decides whether θ' which is equivalent to the angle θ2 in FIG. 3 is changed with a time or not, that is, a nonlinear change is generated or not based on an output of an image sensor 107 (Step S802). If θ' is changed with the time, the processing proceeds to Step S803. If not so, the processing is ended (Step S805).

At the Step S803, the deciding portion 404 decides whether a change rate for a time of θ' is equal to or higher than a predetermined value or not. If the change rate for the time of θ' is equal to or higher than the predetermined value, the processing proceeds to Step S804. If not so, the processing is ended (Step S805).

At the Step S804, there is carried out a processing in which the data on the length of the paper obtained in the processings of FIGS. 6 and 7 are not utilized for forming the image on the second surface of the paper, and the processing is then ended. The processing of the Step S804 is executed in an image formation processing control portion 407, for example. In the case in which the processing of the Step S804 is executed, there is carried out a processing for forming an image on the second surface of the paper using a specified value of a prepared paper dimension without utilizing the data on the length of the paper which are acquired after the formation of the image on the first surface of the paper.

According to the structure, it is possible to prevent an increase in a shift of the image formed on the second surface from the image formed on the first surface from being caused by an increase in an error of the length of the paper which is measured by a length measuring portion 100.

The invention may be utilized in a device for measuring a length of a recording material. Moreover, the invention may be used in an image forming apparatus including the device for measuring a length of a recording material.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A device for measuring a length of a recoding material, comprising:

a rotating body that rotates in contact with a recording material which is transported;

a length measuring unit that measures a length of the recording material based on a rotation of the rotating unit;

a supporting unit that supports the rotating body, the supporting unit moving in a direction that follows a left side or a right side of the recording material, the left side or the right side is a perpendicular direction with respect to a paper delivering direction and along a plane of the recording material, the paper delivering direction defined by the plane of the recording material;

a detecting unit that detects at least one of a rotation and an oblique advance of the recording material;

a correcting unit that corrects a value measured by the length measuring unit based on an output of the detecting unit, wherein the rotation of the recording material is detected by first and second detecting units for detecting different positions of a front end of the recording material, and the oblique advance of the recording material is detected by a side end detecting unit for detecting a position of a side end of the recording material, a rocking angle detecting unit that detects an angle of the movement of the supporting unit; and a comparing unit that compares an angle of the oblique advance obtained by the side end detecting unit with the angle obtained by the rocking angle detecting unit, wherein the first and second detecting unit detects different positions of a rear end of the recording material, and the correcting unit corrects the value measured by the length measuring unit based on a result of the comparison in the comparing unit.

2. The image forming apparatus according to claim 1, wherein the detecting unit detects the oblique advance, the oblique advance is a movement in which the recording material moves in a direction that follows the left side or the right side of the recording material, the left side or the right side is perpendicular with respect to the paper delivering direction.

3. The image forming apparatus according to claim 1, wherein the detecting unit detects the rotation, the rotation is a movement in which the recording material skews to the left side or the right side with respect to the paper delivering direction.

4. The image forming apparatus according to claim 1, wherein the detecting unit detects both the rotation and the oblique advance.

5. An image forming apparatus comprising:

an image forming unit that forms an image on a recording material;

a device that measures a length of the recording material according to claim 1; and a controller that controls the image forming unit based on the value measured by the device for measuring the length of the recording material.

6. The image forming apparatus according to claim 5, further comprising:

a transport detecting unit that detects a transportation in a state in which the recording material rotates; and a deciding unit that decides whether the image forming unit based on the measured value is controlled or not based on an output of the transport detecting unit.

7. The image forming apparatus according to claim 5, wherein the recording material passes through the device after a fixing unit and before a transfer unit.

8. A non-transitory computer readable medium storing a program causing a computer to execute a process for forming an image, the process comprising:

calculating a length of a transported recording material based on rotating of a rotating body in contact with the recording material, the rotating body is supported to move in a direction that follows a left side or a right side of the recording material, the left side or right side is a perpendicular direction with respect to the paper delivering direction and along a plane of the recording material, the paper delivering direction defined by the plane of the recording material;

detecting at least one of the rotation and an oblique advance of the recording material;

correcting the calculated value based on a result of the detecting, detecting the rotation of the recording material for detecting different positions of a front end of the recording material, detecting the oblique advance of the recording material for detecting a position of a side end of the recording material, detecting an angle of the movement of the rotating body; and comparing an angle of the oblique advance obtained with the angle of the movement of the rotating body, detecting different positions of a rear end of the recording material, and correcting the value measured based on a result of the comparison.

* * * * *